US009933202B2

(12) United States Patent
Kang et al.

(10) Patent No.: US 9,933,202 B2
(45) Date of Patent: Apr. 3, 2018

(54) REFRIGERATOR

(71) Applicant: Samsung Electronics Co., Ltd., Gyeonggi-do (KR)

(72) Inventors: Won Soo Kang, Gyeonggi-do (KR); Yong Soo Kyong, Seoul (KR); Jea Won Lee, Gyeonggi-do (KR); Jee-Hoon Lee, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/015,029

(22) Filed: Feb. 3, 2016

(65) Prior Publication Data

US 2016/0222710 A1 Aug. 4, 2016

(30) Foreign Application Priority Data

Feb. 3, 2015 (KR) ..... 10-2015-0016563

(51) Int. Cl.
*F25D 23/02* (2006.01)
*E05F 11/02* (2006.01)

(52) U.S. Cl.
CPC ..... *F25D 23/025* (2013.01); *E05F 11/02* (2013.01); *E05Y 2900/31* (2013.01); *F25D 2323/023* (2013.01)

(58) Field of Classification Search
CPC ..... F25D 23/025; F25D 23/028; F25D 2323/023; F25D 2323/024; E05Y 2900/31; Y10T 16/458
See application file for complete search history.

(56) References Cited

U.S. PATENT DOCUMENTS 2,659,115 A * 11/1953 Anderson ..... E05C 19/161 292/251.5
5,908,228 A * 6/1999 Lee ..... E05B 17/0033 292/251.5

(Continued)

FOREIGN PATENT DOCUMENTS

CN 1508500 A 6/2004
CN 201165778 Y 12/2008

(Continued)

OTHER PUBLICATIONS

Extended European Search Report dated Jun. 20, 2016 in connection with European Application No. 16153498.7, 4 pages.

(Continued)

*Primary Examiner* — Justin B Rephann

(57) ABSTRACT

Disclosed herein is a refrigerator capable of opening a first door with a small force using an auxiliary opening apparatus that decreases an opening force for opening the first door. A refrigerator includes a main body, a first door rotatably provided in the front of the main body and including an opening, a second door rotatably provided in front of the first door and configured to open or close the opening, a first handle coupled to a front surface of the first door and configured to open or close the first door, an auxiliary opening apparatus configured to separate the first door from the main body and decrease an opening force of the first door, a handle lever that is provided at the first handle and configured to operate the auxiliary opening apparatus, and a door cap coupled to an upper portion of the first door.

17 Claims, 18 Drawing Sheets

(56) References Cited

U.S. PATENT DOCUMENTS 5,915,805 A * 6/1999 Lee ..... E05B 17/0033 292/251.5
5,988,709 A * 11/1999 Lee ..... E05B 65/0042 292/199
7,984,955 B2 * 7/2011 Jung ..... F25D 23/028 16/412
8,523,302 B2 9/2013 Shin et al.
2006/0038412 A1 * 2/2006 Muramatsu ..... E05F 1/1215 292/144
2008/0000052 A1 * 1/2008 Hong ..... E05B 17/0033 16/382
2008/0163462 A1 * 7/2008 King ..... E05B 17/0033 16/412
2008/0282505 A1 * 11/2008 Kim ..... E05B 17/0033 16/412
2009/0179540 A1 * 7/2009 Seo ..... E05B 17/0033 312/405
2009/0205357 A1 * 8/2009 Lim ..... E05B 17/0033 62/441
2011/0016907 A1 * 1/2011 Kang ..... F25D 23/028 62/449
2011/0273070 A1 * 11/2011 Shin ..... F25D 23/028 312/405
2012/0280608 A1 * 11/2012 Park ..... E05B 1/0015 312/405
2013/0049562 A1 * 2/2013 Jung ..... F25D 23/028 312/405
2014/0232251 A1 * 8/2014 Kim ..... F25D 23/028 312/404
2015/0292793 A1 * 10/2015 Bischoff ..... F25D 23/028 312/404

FOREIGN PATENT DOCUMENTS

CN 101482357 A 7/2009
CN 102235790 A 11/2011
DE 102010003831 10/2011
JP S5084862 7/1975
JP S5785184 5/1982
JP 2003247775 A 9/2003
KR 19990032118 U 7/1999
KR 10-2008-0050672 6/2008
KR 10-2008-0100555 A 11/2008
KR 20110123478 A 11/2011

OTHER PUBLICATIONS

Communication under Rule 71(3) EPC dated Apr. 10, 2017 in connection with European Patent Application No. 16 153 498.7.
Communication from a foreign patent office in a counterpart foreign application, "The First Office Action," Chinese Patent Application No. 2016100769319, Sep. 18, 2017, 15 pages.

* cited by examiner

REFRIGERATOR

CROSS-REFERENCE TO RELATED APPLICATIONS AND CLAIM OF PRIORITY

This present application is related to and claims benefit of Korean Patent Application No. 10-2015-0016563, filed on Feb. 3, 2015 in the Korean Intellectual Property Office, the disclosure of which is incorporated herein by reference.

TECHNICAL FIELD

Embodiments of the present disclosure relate to a refrigerator including a double door.

BACKGROUND

In general, refrigerators are home appliances that include main bodies having inner cases and outer cases, storage compartments formed by the inner cases, and cold air supply units which supply cold air to the storage compartments, and store the food freshly.

The temperature of the storage compartment is maintained in a predetermined range desired for storing the food freshly.

Such a storage compartment of the refrigerator is provided with a front opening, and the front opening is sealed by a door at ordinary times so that the temperature of the storage compartment is maintained.

The storage compartment is partitioned into a refrigerator compartment positioned at the right and a freezer compartment positioned at the left by a partition, each of the refrigerator compartment and the freezer compartment is opened or closed by a refrigerator compartment door or a freezer compartment door rotatably coupled to the main body.

The refrigerator compartment door is provided with a double door structure for optimizing consumer's convenience includes a first door rotatably coupled to the main body and a second door rotatably coupled to the first door, and handles are respectively provided at the first door and the second door to open or close the first door and the second door.

Since the handles are respectively provided at the first door and the second door, when the first door is open or closed, a consumer grips the handle provided at the first door to open or close the first door, and when the second door is open or closed, the consumer grips the handle provided at the second door to open or close the second door.

A gasket magnet, provided at a rear surface of the first door, is provided with a magnetic force greater than a gasket magnet provided at a rear surface of the second door so that when the consumer grips the handle provided at the second door to open or close the second door, only the second door is opened and the first door is maintained in a closed state.

Since the gasket magnet provided at the rear surface of the first door has a relatively greater magnetic force, there is an inconvenience in consumer needs to exert a great force to grip the handle provided at the first door to open the first door.

SUMMARY

To address the above-discussed deficiencies, it is a primary to provide a refrigerator capable of opening a first door with a small force using an auxiliary opening apparatus which decreases an opening force for opening the first door.

It is another aspect of the present disclosure to provide a refrigerator in which a guide portion, which is provided in a first door and enables an auxiliary opening apparatus to pass through the first door and to contact a main body, is coupled with a door cap to be coupled with an upper portion of the first door.

Additional aspects of the disclosure will be set forth in part in the description which follows and, in part, will be obvious from the description, or may be learned by practice of the disclosure.

In accordance with one aspect of the present disclosure, a refrigerator includes a main body including a storage compartment, a first door rotatably provided in the front of the main body and including an opening, a second door rotatably provided in front of the first door and configured to open or close the opening, a first handle coupled to a front surface of the first door and configured to open or close the first door, a second handle provided at the second door and configured to open or close the second door, an auxiliary opening apparatus configured to separate the first door from the main body and decrease an opening force of the first door, a handle lever that is provided at the first handle and configured to operate the auxiliary opening apparatus, and a door cap coupled to an upper portion of the first door, wherein a guide portion configured to guide the auxiliary opening apparatus connected to the handle lever to pass through the first door and contact the main body and is coupled to the door cap.

The first handle may include a handle bar, a handle lever coupling unit provided at the handle bar so that the handle lever is rotatably coupled thereto, and a handle cap coupled to an upper portion of the handle bar and configured to prevent the auxiliary opening apparatus connected to the handle lever from being exposed to an outside of the refrigerator.

The handle lever may include a rotation unit configured to rotatably couple to the handle lever coupling unit, an insertion portion into which the auxiliary opening apparatus is inserted, and a push portion to which an external force is applied so that the handle lever rotates about the rotation unit in a direction toward a front surface of the first door.

An elastic member may be provided between the handle lever and the first handle.

The auxiliary opening apparatus may include a first rack configured to connect to the insertion portion and straightly move forward or backward, a pinion gear configured to engage with the first rack and rotate when the first rack straightly moves, and a second rack configured to engage with the pinion gear and straightly move in a direction opposite to the first rack when the pinion gear rotates.

The first rack may include an insertion protrusion configured to insert into the insertion portion, and a first rack gear configured to engage with the pinion gear.

The second rack may include a rack gear portion in which a second rack gear is configured to engage with the pinion gear is provided, a contact portion configured to contact the main body, and a connection portion that is provided between the rack gear portion and the contact portion and comprises a diameter less than those of the rack gear portion and the contact portion, wherein a spring may be provided on the connection portion.

The pinion gear may include a first gear configured to engage with the first rack gear, a second gear configured to engage with the second rack gear, and a rotational shaft configured to rotatably couple the pinion gear to the guide portion.

The door cap may include an accommodation portion in which a part of the guide portion is accommodated, a first coupling hole to which the guide portion is coupled, a cover that is coupled to an upper portion of the guide portion and configured to cover the upper portion of the guide portion, and a through hole through which the contact portion contacts the main body.

The cover may include a first rotational hole to which the rotational shaft is rotatably coupled, and a second fastening hole that is provided at a position corresponding to a first fastening hole provided in the guide portion and configured to fasten the cover to the guide portion.

The guide portion may include an insertion hole into which the first rack is inserted, a first guide configured to guide the first rack inserted in the insertion hole to straightly move forward or backward, a second guide configured to guide the second rack to straightly move forward or backward, an opening that is provided behind the second guide and includes a size less than a diameter of the contact portion and greater than a diameter of the connection portion, a second rotational hole to which the rotational shaft is rotatably coupled, and a second coupling hole provided at a position corresponding to the first coupling hole.

One side of the spring may be supported by a first support portion provided at an edge of the opening, the other end of the spring may be supported by a second support portion provided at the rack gear portion, and the spring may be compressed when the second rack moves backward.

When the push portion of the handle lever is pushed in a direction toward the front surface of the first door, the handle lever may be rotated in the direction toward the front surface of the first door, and the first rack inserted into the insertion portion may be moved forward.

When the first rack moves forward, the second rack may be moved backward and compress the spring, and the contact portion may push the fixed main body to separate the first door from the main body.

When an external force applied to the handle lever is released in a state in which the first door separated from the main body is open, the second rack may be moved forward due to a compressive force of the spring, and the first rack may be moved backward.

In accordance with another aspect of the present disclosure, a refrigerator includes a main body including a storage compartment, a first door rotatably provided in the front of the main body and including an opening, a second door which is rotatably provided in front of the first door and configured to open or close the opening, an auxiliary opening apparatus configured to separate the first door from the main body and decreases an opening force of the first door, a handle lever that is provided at a first handle coupled to a front surface of the first door and configured to operate the auxiliary opening apparatus, a guide portion configured to guide the auxiliary opening apparatus connected to the handle lever to pass through the first door and contact the main body, and a door cap coupled to an upper portion of the first door and including an accommodation portion in which a part of the guide portion is accommodated, a coupling hole to which the guide portion is coupled, a cover configured to cover an upper portion of the guide portion, and a through hole through which the auxiliary opening apparatus contacts the main body.

The auxiliary opening apparatus may include a first rack that is connected to the handle lever and configured to straightly move forward or backward, a pinion gear configured to engage with the first rack and rotate when the first rack straightly moves, and a second rack configured to engage with the pinion gear and straightly move in a direction opposite to the first rack when the pinion gear rotates.

The guide portion may include an insertion hole into which the first rack is inserted, a first guide configured to guide the first rack inserted into the insertion hole to straightly move forward or backward, a second guide configured to guide the second rack to straightly move forward or backward, and a rotational hole to which a rotational shaft of the pinion gear is rotatably coupled.

In accordance with still another aspect of the present disclosure, a refrigerator includes a main body including a storage compartment, a first door rotatably provided in the front of the main body and including an opening, a second door that is rotatably provided in front of the first door and configured to open or close the opening, an auxiliary opening apparatus configured to separate the first door from the main body and decrease an opening force of the first door, a handle coupled to the first door to open or close the first door, wherein a handle lever is configured to operate the auxiliary opening apparatus is provided at the handle, and a door cap that is coupled to an upper portion of the first door and comprises a space configured to accommodate the auxiliary opening apparatus connected to the handle lever.

In accordance with yet another aspect of the present disclosure, a refrigerator includes a main body including a storage compartment, a first door rotatably provided in the front of the main body and including an opening, wherein a gasket is provided at a rear surface of the first door, second door that is rotatably provided in front of the first door and configured to open or close the opening, an auxiliary opening apparatus configured to separate the first door from the main body and decrease an opening force of the first door, a handle coupled to the first door and configured to open or closes the first door, wherein a handle lever is configured to operate the auxiliary opening apparatus is provided at the handle, and a door cap which is coupled to an upper portion of the first door and comprises a space configured to accommodate the auxiliary opening apparatus, wherein the auxiliary opening apparatus is accommodated in the door cap, is provided in the first door, and comprises one side connected to the handle lever, and another side configured to pass through the door cap at an upper portion of the gasket and contact the main body.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
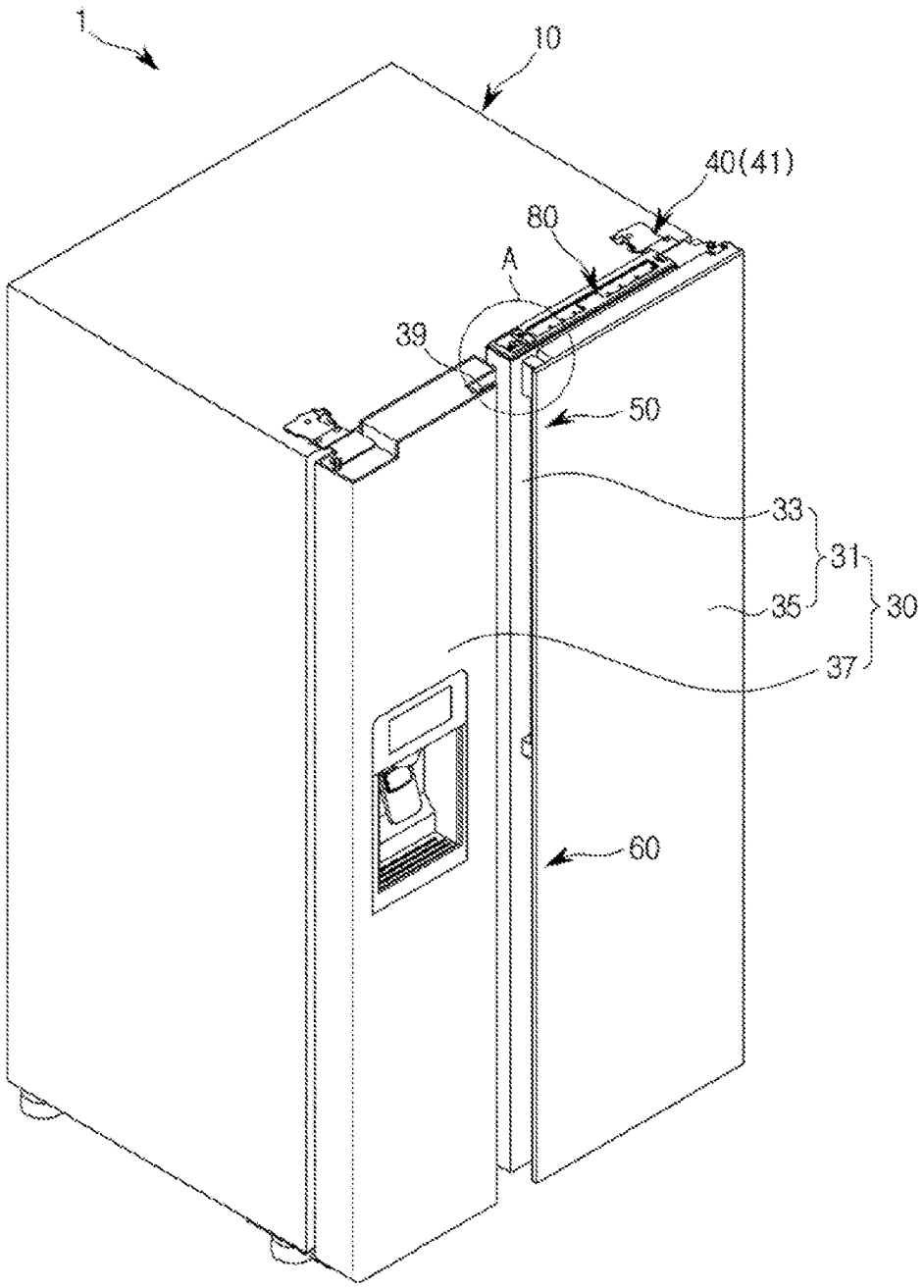
FIG. 1 illustrates a refrigerator according to various embodiments of the present disclosure.
Figure 2:
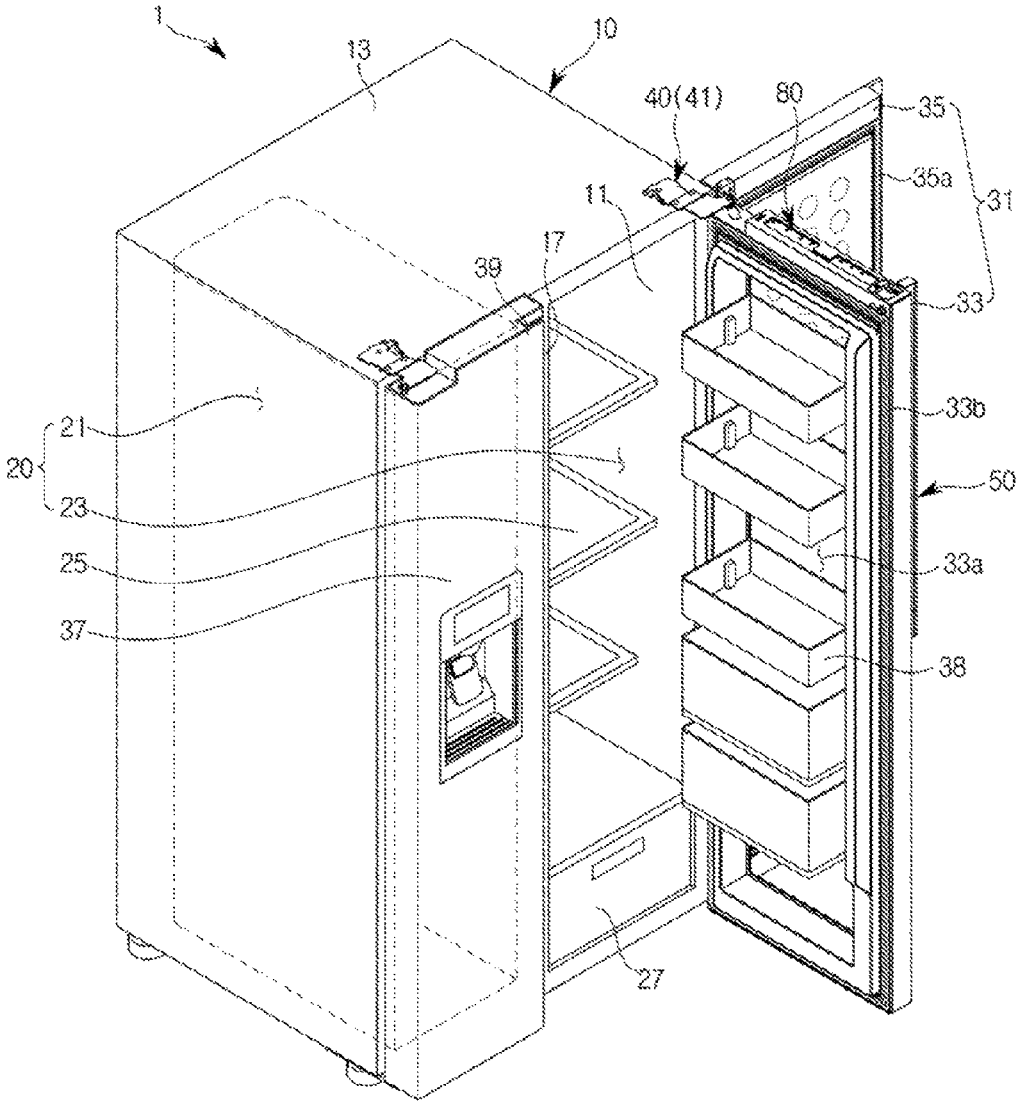
FIG. 2 illustrates when each of a first door and a second door of the refrigerator is open according to one embodiment of the present disclosure.
Figure 3:
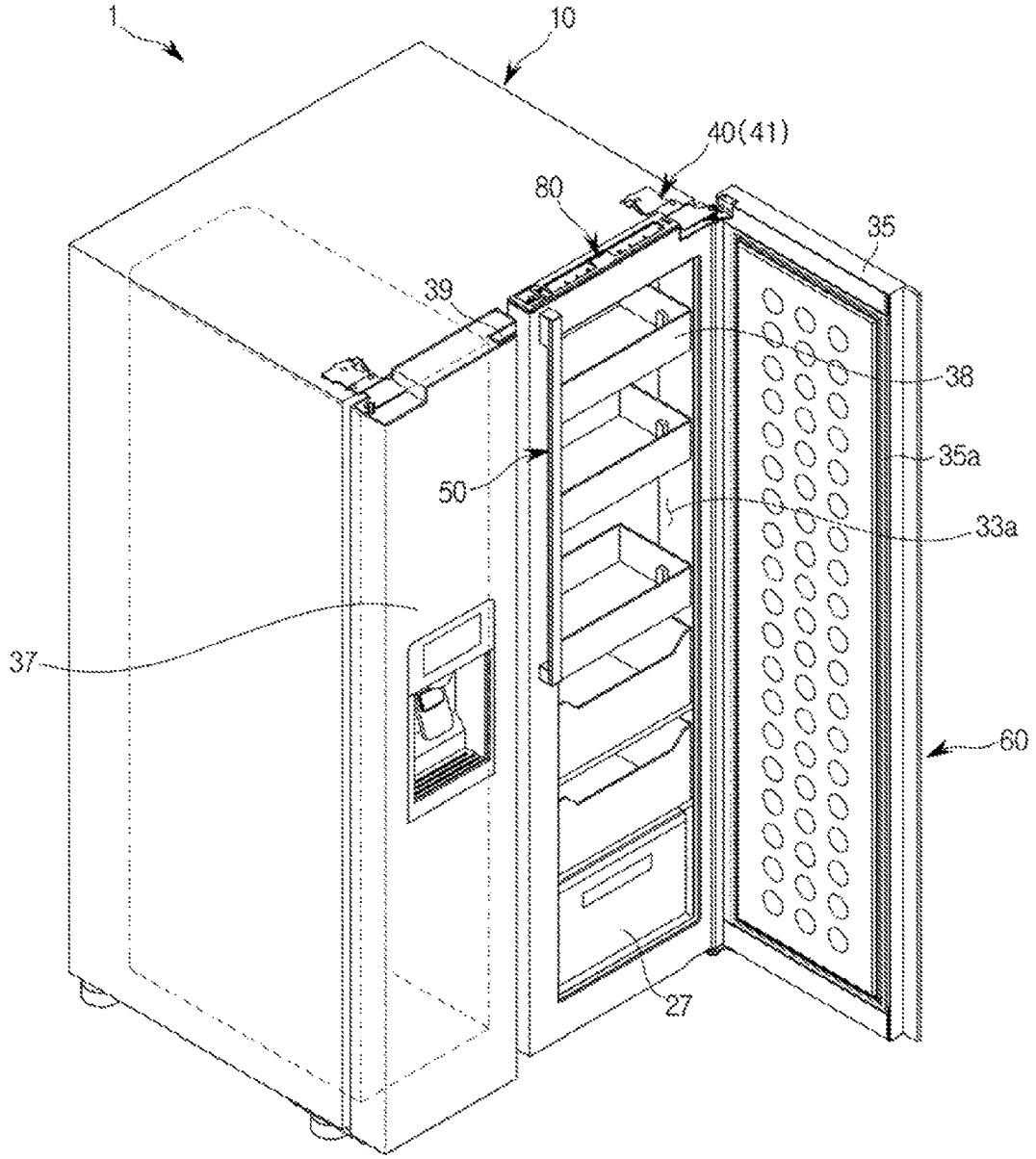
FIG. 3 illustrates when the second door of the refrigerator is open according to various embodiments of the present disclosure.
Figure 4:
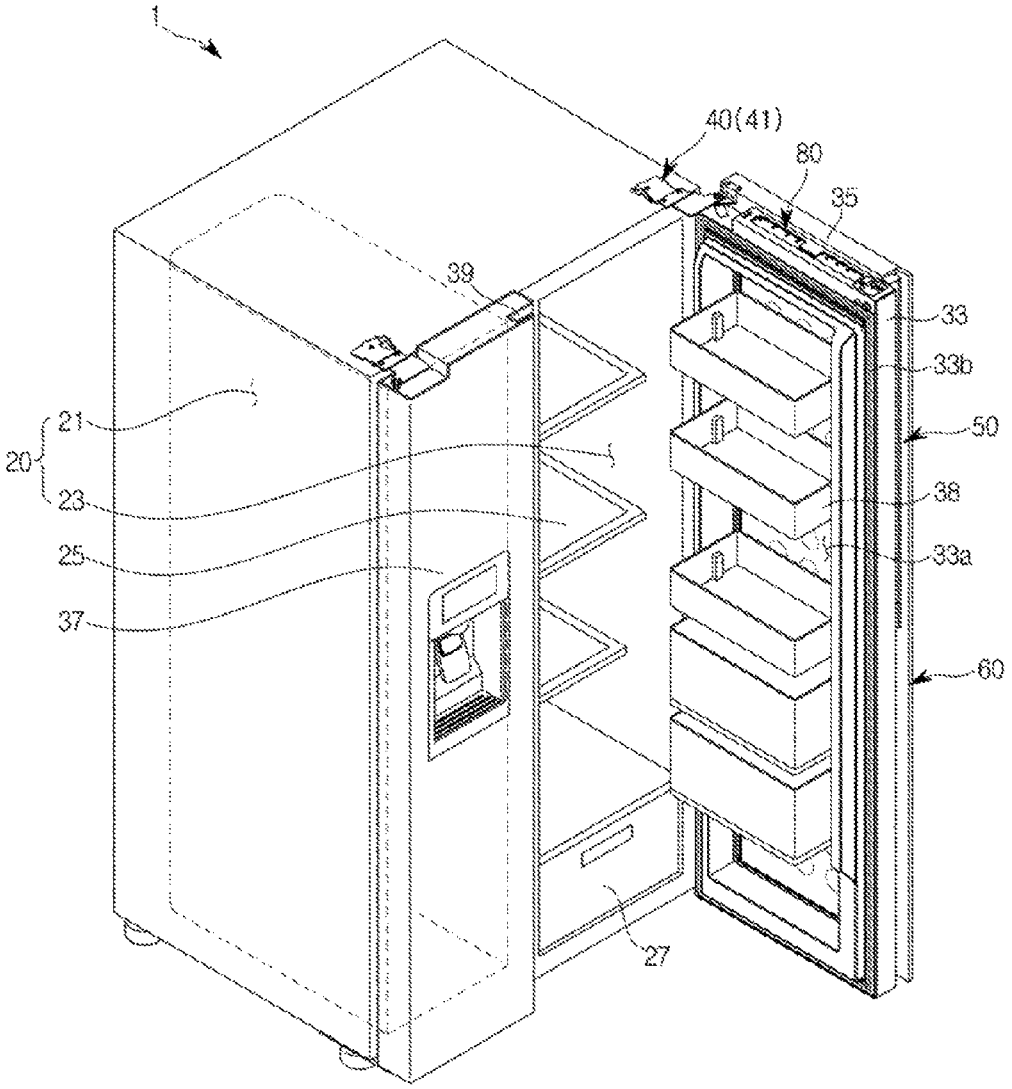
FIG. 4 illustrates when both of the first door and the second door of the refrigerator are open according to various embodiments of the present disclosure.
Figure 5:
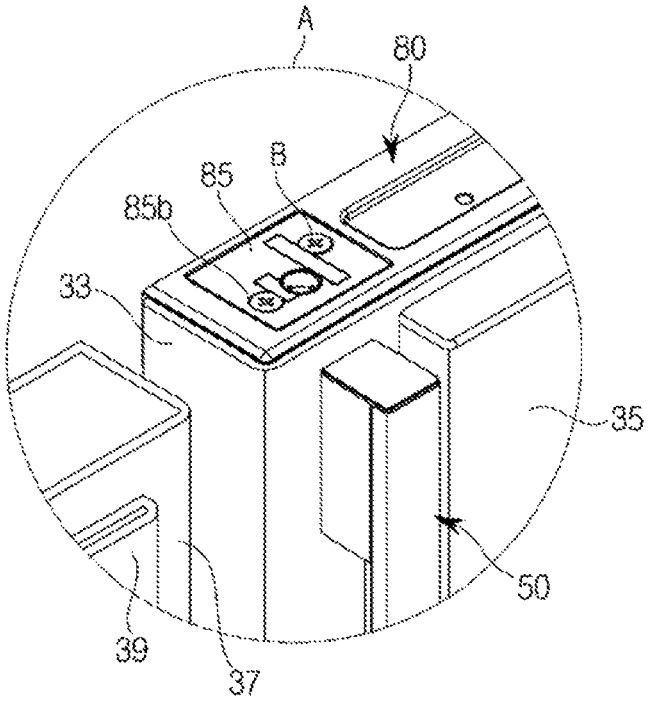
FIG. 5 illustrates portion A of FIG. 1 according to various embodiments of the present disclosure.
Figure 6:
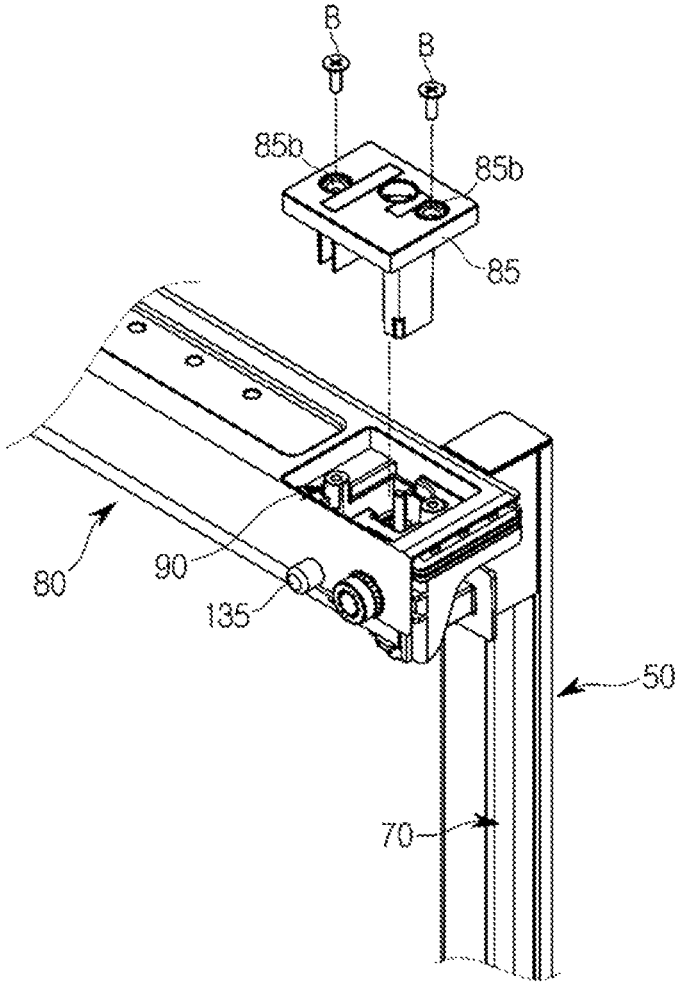
FIG. 6 illustrates when a cover is separated from a door cap according to various embodiments of the present disclosure.
Figure 7:
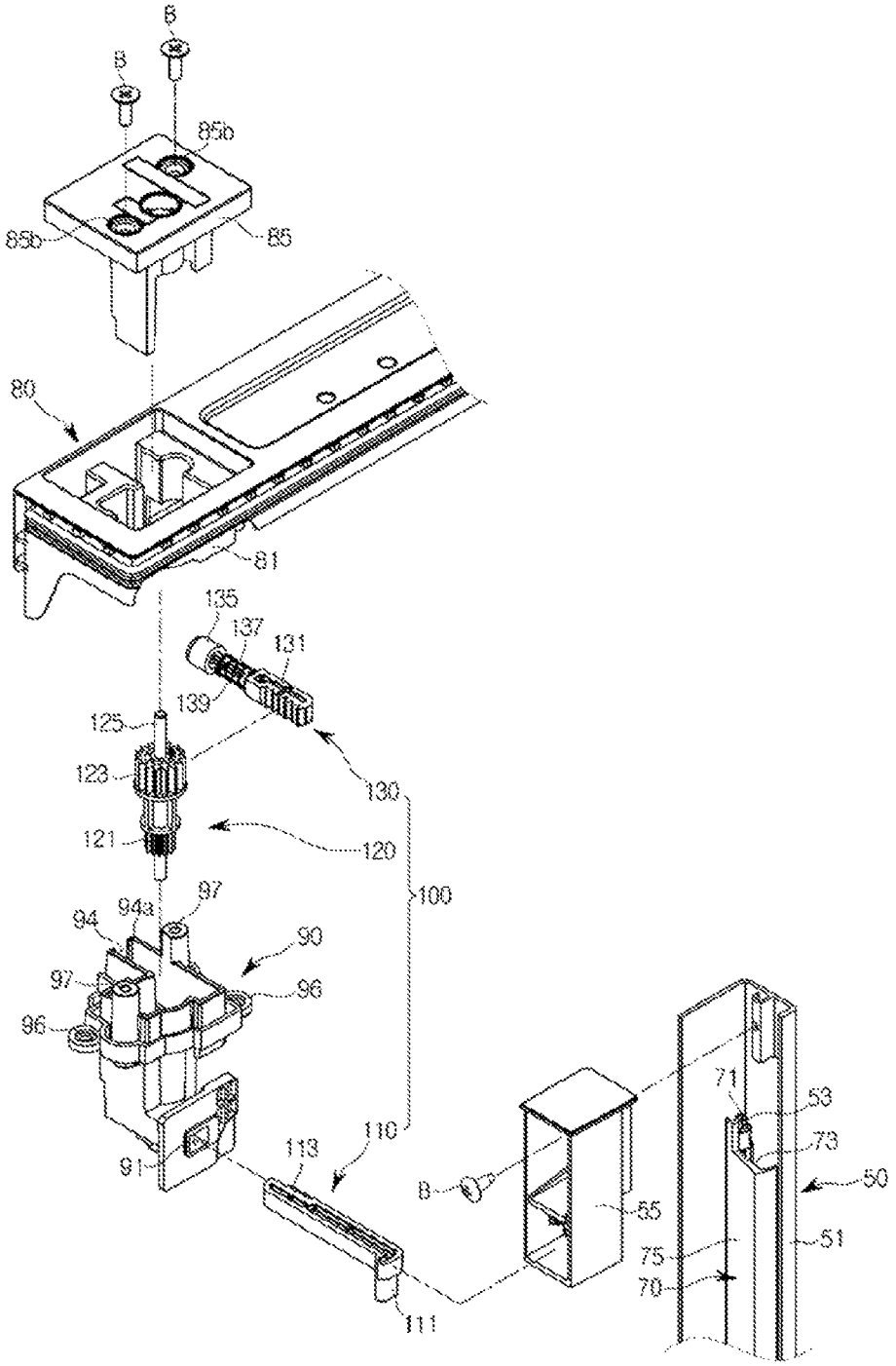
FIG. 7 illustrates a first handle coupled to a handle lever, an auxiliary opening apparatus, a guide portion, and the door cap according to various embodiments of the present disclosure.
Figure 8:
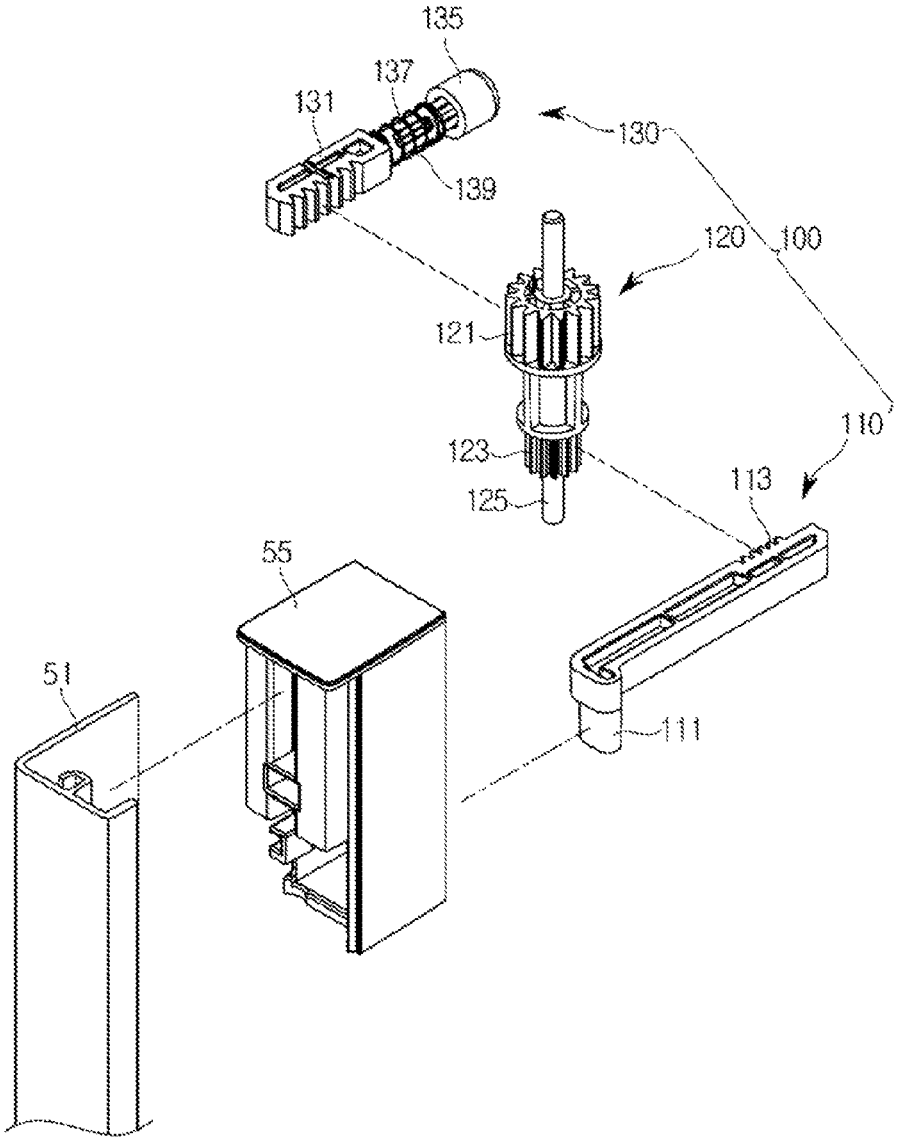
FIG. 8 illustrates when a first rack of the auxiliary opening apparatus is coupled to the first handle through a handle cap according to various embodiments of the present disclosure.
Figure 9:
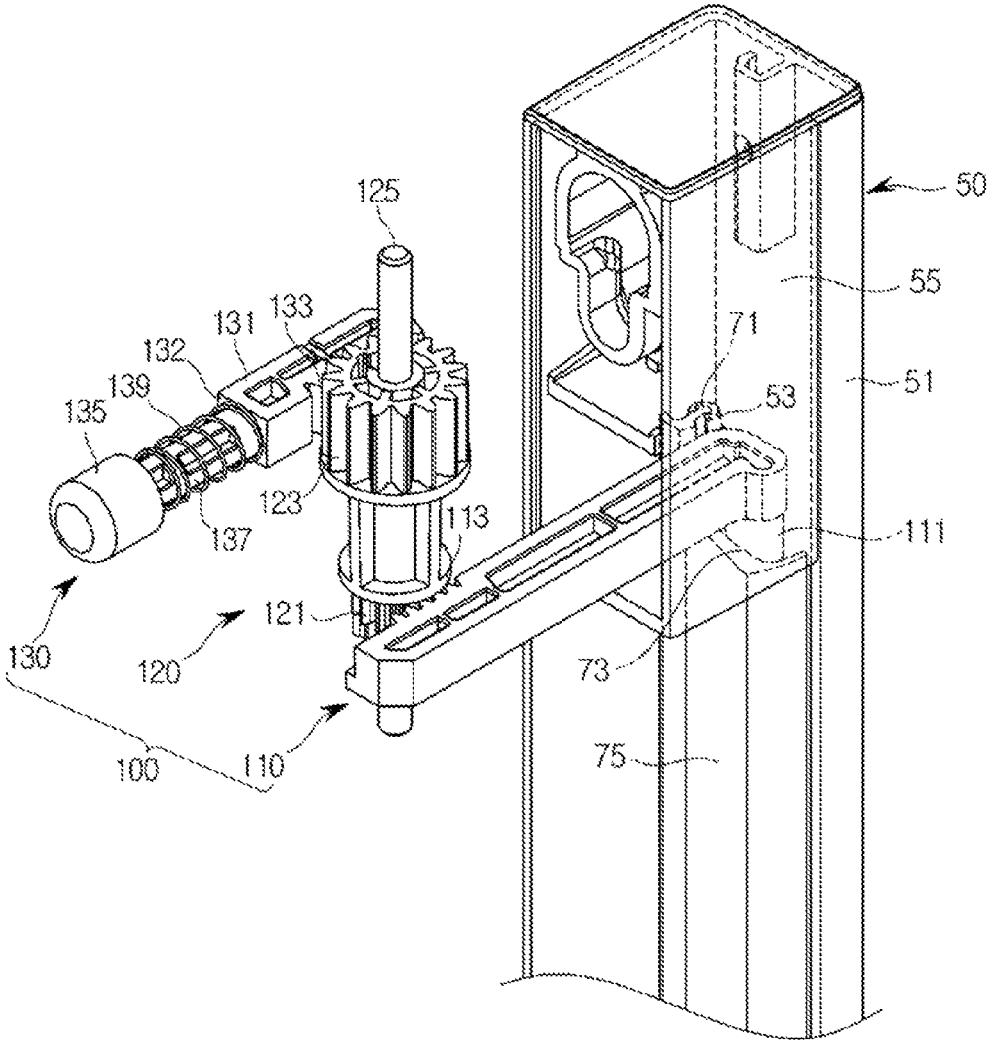
FIG. 9 illustrates when the auxiliary opening apparatus is connected to the handle lever according to various embodiments of the present disclosure.
Figure 10:
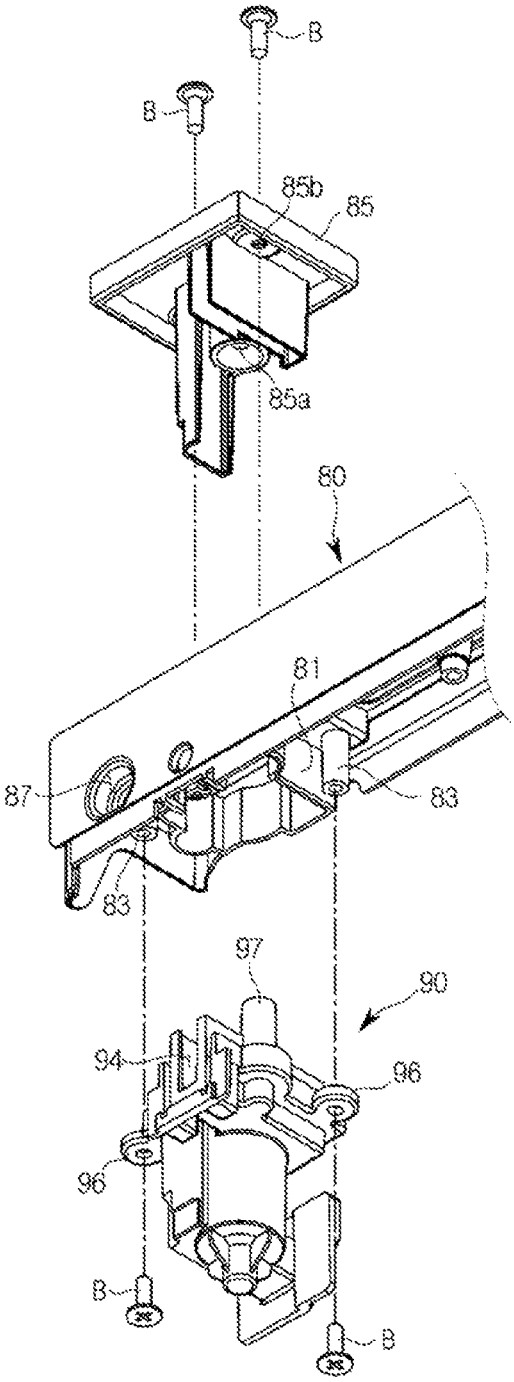
FIG. 10 illustrates when the guide portion is coupled to the door cap according to various embodiments of the present disclosure.
Figure 11:
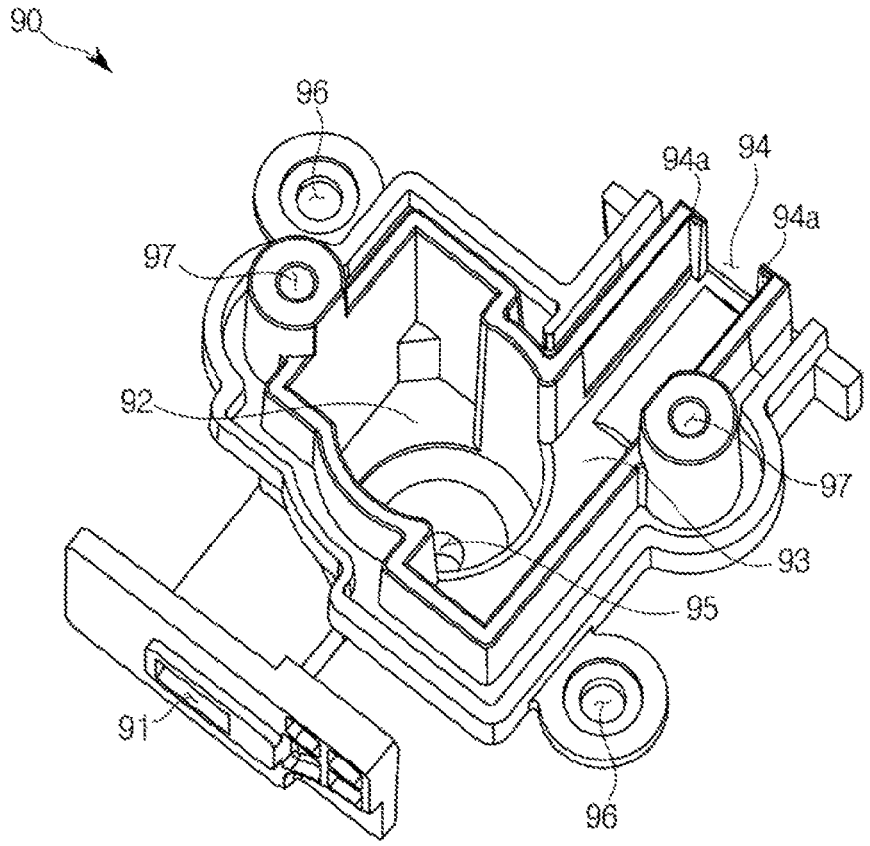
FIG. 11 illustrates the guide portion according to various embodiments of the present disclosure.

FIGS. 1 through 18, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Hereinafter, embodiments of the present disclosure will be described in detail with reference to the following drawings.

A front surface and a forward direction which will be used below respectively refer to a front surface of a main body 10 of a refrigerator 1 and a direction in front thereof, and a backward direction refers to a direction toward the rear thereof.

As illustrated in FIGS. 1 to 4, the refrigerator 1 includes a main body 10, a storage compartment 20 which is provided in the main body 10 and has a front surface to be open, a door 30 which is rotatably provided in the front of the main body 10 and opens or closes the storage compartment 20, and a hinge unit 40 including an upper hinge 41 and a lower hinge (not shown) which enable the door 30 to be rotatably coupled to the main body 10.

The main body 10 includes an inner box 11 forming the storage compartment 20, an outer box 13 forming an exterior, and a cold air supply unit (not shown) which supplies cold air to the storage compartment 20.

Figure 12:
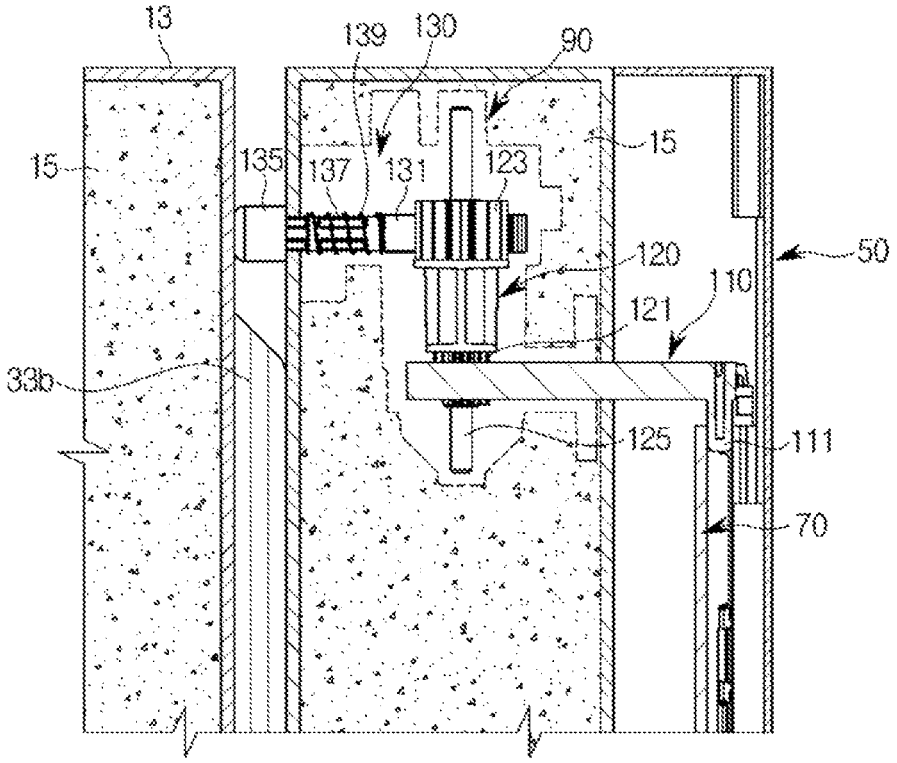
FIG. 12 illustrates when the first door of the refrigerator is closed according to various embodiments of the present disclosure.

The cold air supply unit may include a compressor, a condenser, an expansion valve, an evaporator, a blast fan, a cold air duct, and the like, an insulation member 15 foams between the inner box 11 and the outer box 13 of the main body 10 to prevent a cold air leak of the storage compartment 20, and the insulation member 15 also foams in the door 30 (see FIG. 12).

A machinery compartment (not shown) in which the compressor and the condenser, which respectively compresses a refrigerant and condenses the compressed refrigerant, are provided at a lower portion of the rear of the main body 10.

The storage compartment 20 is partitioned by the partition 17 into the left or right, a refrigerator compartment 21 is provided at the right in the main body 10, and a freezer compartment 23 is provided at the left in the main body 10.

Even though the refrigerator compartment 21 is provided at the right in the main body 10 and the freezer compartment 23 is provided at the left, the layout is not limited thereto.

A plurality of shelves 25 are provided and divides the refrigerator compartment 21 into a plurality of sub spaces for keeping food and the like thereon, and a storage container 27 which accommodates food and the like and stores.

The refrigerator compartment 21 and the freezer compartment 23 are respectively opened or closed by a refrigerator compartment door 31 and a freezer compartment door 37 pivot coupled to the main body 10, and the upper hinge 41 and the lower hinge are respectively coupled to an upper portion and a lower portion of the main body 10 so that the refrigerator compartment door 31 and the freezer compartment door 37 are rotatably coupled to the main body 10.

The refrigerator compartment door 31 is rotatably provided in the front of the main body 10 and includes a first door 33 having an opening 33*a* and a second door 35 which is rotatably provided in front of the first door 33 and opens or closes the opening 33*a*.

The opening 33*a* is provided with a width less than that of the refrigerator compartment 21, and a plurality of door guards 38 are provided at the opening 33*a*.

Since the second door 35 is provided to open or close the opening 33*a* provided in the first door 33, an entire plurality of door guards 38 provided in a space corresponding to an entire size of the opening 33*a* may be used by opening the second door 35.

Handles 50 and 60 griped by a user, which open or close the refrigerator compartment door 31, are provided at the refrigerator compartment door 31, and a freezer compartment door handle 39 is provided at the freezer compartment door 37 so that the user grips the freezer compartment door handle 39 and opens or closes the freezer compartment door 37.

The handles 50 and 60 provided at the refrigerator compartment door 31 includes a first handle 50 coupled to a front surface of the first door 33 for opening or closing the first door 33 and a second handle 60 provided at the second door 35 for opening or closing the second door 35.

Gaskets, which prevent a leak of cold air of the storage compartment 20 by sealing between the main body 10 and the door 30 when the refrigerator compartment door 31 and the freezer compartment door 37 are closed, are respectively provided on rear surfaces of the refrigerator compartment door 31 and the freezer compartment door 37.

The gaskets provided at the refrigerator compartment door 31 include a first gasket 33*b* provided at a rear surface of the first door 33 and a second gasket 35*a* provided at a rear surface of the second door 35. As a magnetic force of a magnet (not shown) embedded in the first gasket 33*b* is greater than a magnetic force of a magnet (not shown) embedded in the second gasket 35*a*, the first door 33 may be maintained in a closed state when a user grips the second handle 60 and opens the second door 35.

The second handle 60 may be integrally provided with the second door 35 at a side of the second door 35. The first handle 50 coupled to an upper portion of a front surface of the first door 33 is prevented from being exposed to the front surface by the second handle 60 when the second door 35 is closed.

As illustrated in FIGS. 5 to 11, an auxiliary opening apparatus 100, which decreases an opening force by separating the first door 33 from the main body 10 when a user grips the first handle 50 and opens the first door 33, is provided in the first door 33.

The auxiliary opening apparatus 100 is operated by a handle lever 70 provided in the first handle 50.

The first handle 50 includes a handle bar 51 forming a front exterior, a handle lever coupling unit 53 provided in the handle bar 51 so that the handle lever 70 is rotatably coupled thereto, and a handle cap 55 coupled to an upper portion of the handle bar 51 so that the auxiliary opening apparatus 100 connected to the handle lever 70 is prevented from being exposed to the outside.

The handle lever coupling unit 53 may be provided at a side of the upper portion of the handle bar 51 and may rotate about a rotation unit 71 such that the handle lever 70 is coupled to the handle lever coupling unit 53 in a forward or backward direction.

The handle cap 55 is coupled to the upper portion of the handle bar 51 by coupling members B, and a side of a lower portion of a rear of the handle cap 55 is open so that a part of the auxiliary opening apparatus 100 is connected to the handle lever 70 through the handle cap 55. The part of the auxiliary opening apparatus 100 connected to the handle lever 70 through the handle cap 55 is prevented from being exposed to the outside by the handle cap 55.

The handle lever 70 includes a rotation unit 71 rotatably coupled to the handle lever coupling unit 53, an insertion portion 73 into which an insertion protrusion 111 provided at the first rack 110 of the auxiliary opening apparatus 100 is inserted, and a push portion 75 that applies an external force so that the handle lever 70 rotates about the rotation unit 71 in a direction toward the front surface of the first door 33.

As the handle lever 70 is coupled to the handle lever coupling unit 53 to rotate about the rotation unit 71 in a forward or backward direction, when a user grips the first handle 50 and pushes the push portion 75 of the handle lever 70 in a forward direction of the first door 33, the handle lever 70 rotates about the rotation unit 71 in a forward direction.

When the handle lever 70 rotates around the rotation unit 71 in a forward direction, the first rack 110 inserted into the insertion portion 73 straightly moves in a forward direction of the first door 33.

Even though not illustrated in the drawings, an elastic member (not shown) is provided at a lower end of the handle lever 70 not connected to the auxiliary opening apparatus 100 between the handle lever 70 and the handle bar 51 of the first handle 50. When a user pushes the push portion 75, the elastic member is compressed by the handle lever 70 that rotates around the rotation unit 71 in a forward direction and keeps a compressive force. When the external force applied to the push portion 75 by the user is released, the handle lever 70 is rotated around the rotation unit 71 in a backward direction due to the compressive force of the elastic member. In addition, a movement of the lower end of the handle lever 70 may be prevented by the elastic member.

The auxiliary opening apparatus 100 is operated by the handle lever 70, is coupled to a door cap 80 which will be describe below, and is guided to pass through the first door 33 and to contact the main body 10 by a guide portion 90 installed in the first door 33.

The auxiliary opening apparatus 100 includes a first rack 110 which is connected to the insertion portion 73 of the handle lever 70 and straightly moves forward or backward, a pinion gear 120 which is engaged with the first rack 110 and rotates when the first rack 110 straightly moves, and a second rack 130 which is engaged with the pinion gear 120 and straightly moves in a direction opposite to that of the first rack 110 when the pinion gear 120 rotates.

The first rack 110 includes the insertion protrusion 111 that is inserted into the insertion portion 73 of the handle lever 70 and connects the first rack 110 to the handle lever 70 and a first rack gear 113 that is engaged with the pinion gear 120 and rotates the pinion gear 120 when the first rack 110 straightly moves.

When a user grips the first handle 50 and pushes the handle lever 70 in a forward direction of the first door 33, the first rack 110 connected to the handle lever 70 straightly moves forward with the handle lever 70.

The pinion gear 120 includes a first gear 121 engaged with the first rack gear 113 of the first rack 110, a second gear portion 123 provided at an upper portion of the first gear 121 to be engaged with a second rack gear 133 of the second rack 130, and a rotational shaft 125 that rotatably couples the pinion gear 120 to the guide portion 90 and the a cover 85 of the door cap 80.

Since the first gear 121 is engaged with first rack gear 113 of the first rack 110, when the first rack 110 straightly moves forward by the handle lever 70, the pinion gear 120 rotates about the rotational shaft 125 in a counterclockwise direction.

Since the second gear portion 123 is engaged with the second rack gear 133 of the second rack 130, the pinion gear 120 that rotates about the rotational shaft 125 in the counterclockwise direction straightly moves the second rack 130 backward.

The second rack 130 includes a rack gear portion 131 in which the second rack gear 133 engaged with the second gear portion 123 of the pinion gear 120 is provided, a contact portion 135 in contact with the main body 10, and a connection portion 137 which is interposed between the rack gear portion 131 and the contact portion 135 and has a diameter less than thicknesses of the rack gear portion 131 and the contact portion 135.

When the first rack 110 straightly moves forward by the handle lever 70, the second rack 130 straightly moves backward by the pinion gear 120 that is rotated by the first rack 110.

When the second rack 130 straightly moves backward, since the contact portion 135 in contact with the main body 10 pushes the fixed main body 10, the first door 33 is separated from the main body 10.

When the first door 33 is separated from the main body 10, and a user grips the first handle 50 and opens the first door 33, the user may easily open the first door 33 using a small force.

A spring 139 is provided at the connection portion 137, one side of the spring 139 is supported by a first support portion 94*a* provided at an edge of an opening 94, and the other side of the spring 139 is supported by a second support portion 132 provided at the rack gear portion 131.

Since the both sides of the spring 139 are respectively supported by the first support portion 94*a* and the second support portion 132, when an external force is applied to the handle lever 70 and the second rack 130 straightly moves backward, the spring 139 is compressed, and when the external force applied to the handle lever 70 is released in a state in which the first door 33 is open, the second rack 130 straightly moves forward due to the compressive force of the spring 139.

The door cap 80 is coupled to an upper portion of the first door 33 and covers the upper portion of the first door 33, and the guide portion 90 which guides the auxiliary opening apparatus 100 connected to the handle lever 70 to pass through the first door 33 and to contact the main body 10 is coupled to the door cap 80.

An accommodation portion 81 in which a part of the guide portion 90 is accommodated, a first coupling hole 83 to which the guide portion 90 is coupled, the cover 85 which is coupled to an upper portion of the guide portion 90 and covers the upper portion of the guide portion 90, and a through hole 87 through which the contact portion 135 of the second rack 130 contacts the main body 10 are provided in the door cap 80.

The accommodation portion 81 is provided at a lower portion of the door cap 80 to have a shape corresponding to the upper portion of the guide portion 90 coupled to the door cap 80 and accommodates the upper portion of the guide portion 90.

When the part of the guide portion 90 is accommodated in the accommodation portion 81, as the first coupling hole 83 is provided at a position corresponding to the second coupling hole 97 of the guide portion 90, the guide portion 90 may be coupled to the door cap 80 with the fastening member B.

The cover 85 is coupled to the upper portion of the guide portion 90 and includes a first rotational hole 85*a* to which the rotational shaft 125 of the pinion gear 120 is rotatably coupled and a second fastening hole 85*b* which is provided at a position corresponding to a first fastening hole 96 provided at the guide portion 90 and fastens the cover 85 to the guide portion 90.

The pinion gear 120 may be rotated by a straight line movement of the first rack 110 and the second rack 130 due to the first rotational hole 85*a* provided in the cover 85 to which an upper end of the rotational shaft 125 of the pinion gear 120 is rotatably coupled, and the second rotational hole 95 of the guide portion 90 to which the a lower end of the rotational shaft 125 of the pinion gear 120 is rotatably coupled.

The second fastening hole 85*b* is provided at a position corresponding to the first fastening hole 96 of the guide portion 90 and fastens the cover 85 to the guide portion 90 by the fastening member B.

The through hole 87 is provided in a rear surface of the door cap 80 corresponding to a position of an opening 94 of the guide portion 90.

Since the opening 94 of the guide portion 90 is provided behind the second guide 93, the contact portion 135 provided in the second rack 130 guided by the second guide 93 passes through the first door 33 by the opening 94 and the through hole 87 and contacts the main body 10.

The guide portion 90 is coupled to the lower portion of the door cap 80, is installed in the first door 33, and guides the auxiliary opening apparatus 100 connected to the handle lever 70 to pass through the first door 33 and to contact the main body 10.

The guide portion 90 includes an insertion hole 91 into which the first rack 110 is inserted, a first guide 92 which guides the first rack 110 inserted into the insertion hole 91 to straightly move forward or backward, a second guide 93 which guides the second rack 130 to straightly move forward or backward, the opening 94 which is provided behind the second guide 93 and has a size less than a diameter of the contact portion 135 of the second rack 130 and greater than a diameter of the connection portion 137, a second rotational hole 95 to which the rotational shaft 125 of the pinion gear 120 is rotatably coupled, the first fastening hole 96 which is provided at a position corresponding to the second fastening hole 85*b* provided in the cover 85 and fastens the cover 85 to the guide portion 90, and a second coupling hole 97 which is provided at a position corresponding to the first coupling hole 83 of the door cap 80 and couples the guide portion 90 to the door cap 80.

The insertion hole 91 is provided so that the first rack 110 connected to the handle lever 70 is inserted, and the first rack 110 connected to the first guide 92 and inserted into the insertion hole 91 is guided to straightly move forward or backward by the first guide 92.

The second guide 93 is positioned at an upper side higher than the first guide 92 to correspond to the second rack 130 positioned at an upper side higher than the first rack 110 and guides the second rack 130 to straightly move forward or backward.

The opening 94 is provided behind the second guide 93 to be connected to second guide 93, is provided with a size less than the diameter of the contact portion 135 of the second rack 130 so that the contact portion 135 does not pass through the opening 94, and is provided with a size greater than the diameter of the connection portion 137 of the second rack 130 so that the connection portion 137 passes through the opening 94.

Since the connection portion 137 is provided to pass through the opening 94, the second rack 130 may be guided to straightly move forward or backward by the second guide 93.

The pinion gear 120 may be rotated by a straight movements of the first rack 110 and the second rack 130 due to the second rotational hole 95 to which the lower end of the rotational shaft 125 of the pinion gear 120 is rotatably coupled and the first rotational hole 85*a* of the cover 85 to which the upper end of the rotational shaft 125 of the pinion gear 120 is rotatably coupled.

The second coupling hole 97 is provided at a position corresponding to the first coupling hole 83 provided in the door cap 80 and couples the guide portion 90 to the door cap 80 by the fastening member B.

Next, an operation of the auxiliary opening apparatus operated by the handle lever will be described in detail with reference to FIGS. 12 to 18.

Figure 13:
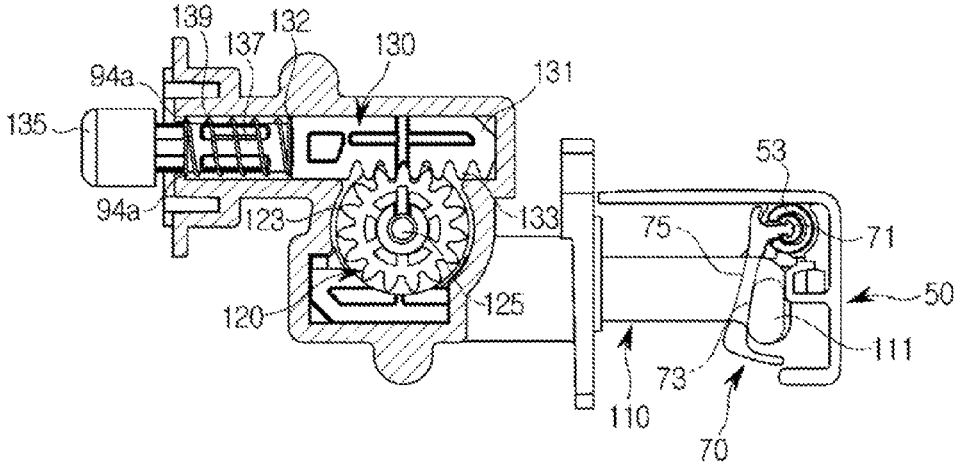
FIGS. 13 and 14 illustrate positions of the handle lever and the auxiliary opening apparatus when the first door of the refrigerator is closed according to various embodiments of the present disclosure.
Figure 14:
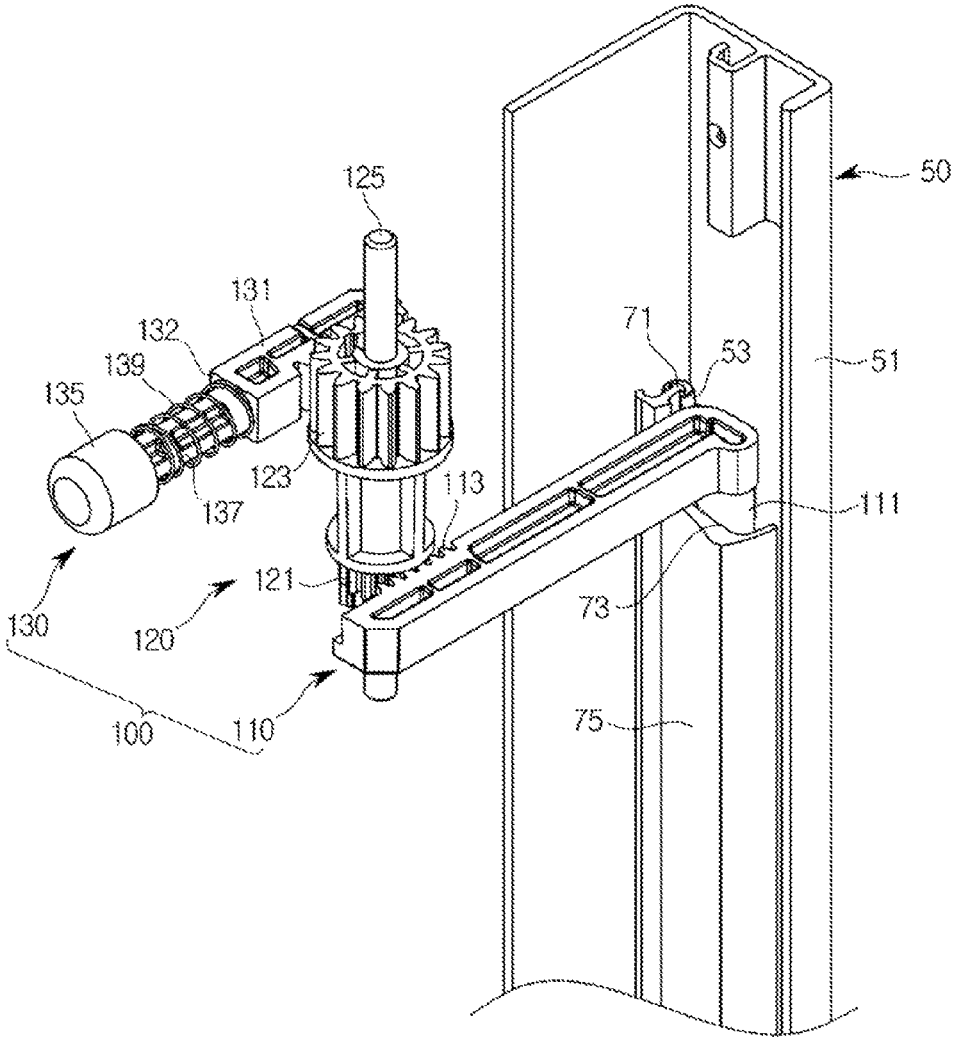

As illustrated in FIGS. 12 to 14, when the first door 33 is closed, the handle lever 70 is rotated about the rotation unit 71 in a backward direction of the first door 33 due to an elastic force of the elastic member.

Since the handle lever 70 rotates in the backward direction, the first rack 110 connected to the handle lever 70 moves backward to a maximum distance, and the second rack 130 moves forward to a maximum distance.

Figure 15:
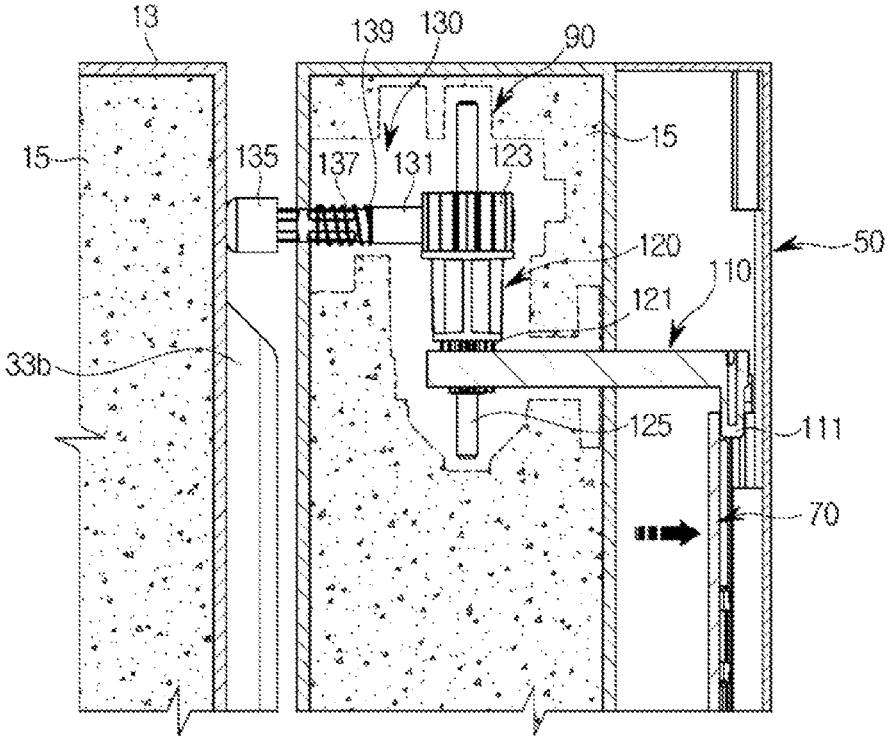
FIG. 15 illustrates when the first door is separated from a main body by the auxiliary opening apparatus of the refrigerator according to various embodiments of the present disclosure.
Figure 16:
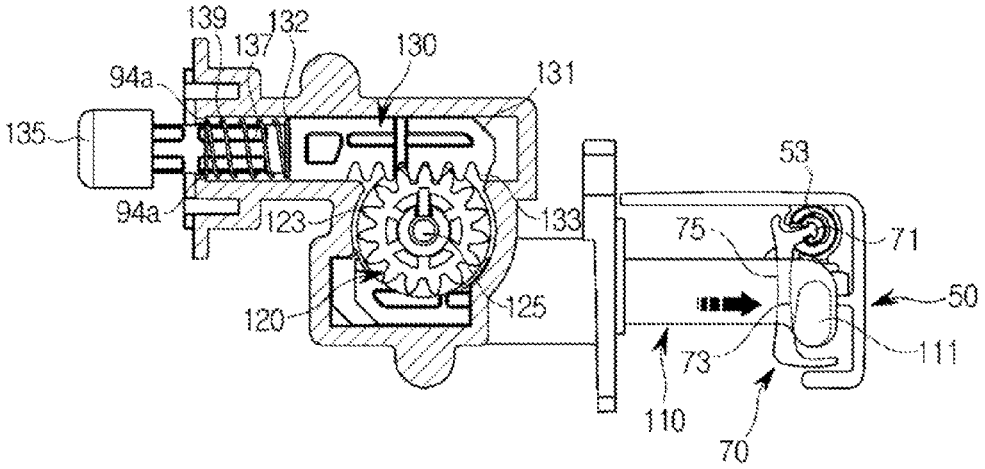
FIGS. 16 and 17 illustrate positions of the handle lever and the auxiliary opening apparatus when the first door of the refrigerator is separated from the main body according to various embodiments of the present disclosure.
Figure 17:
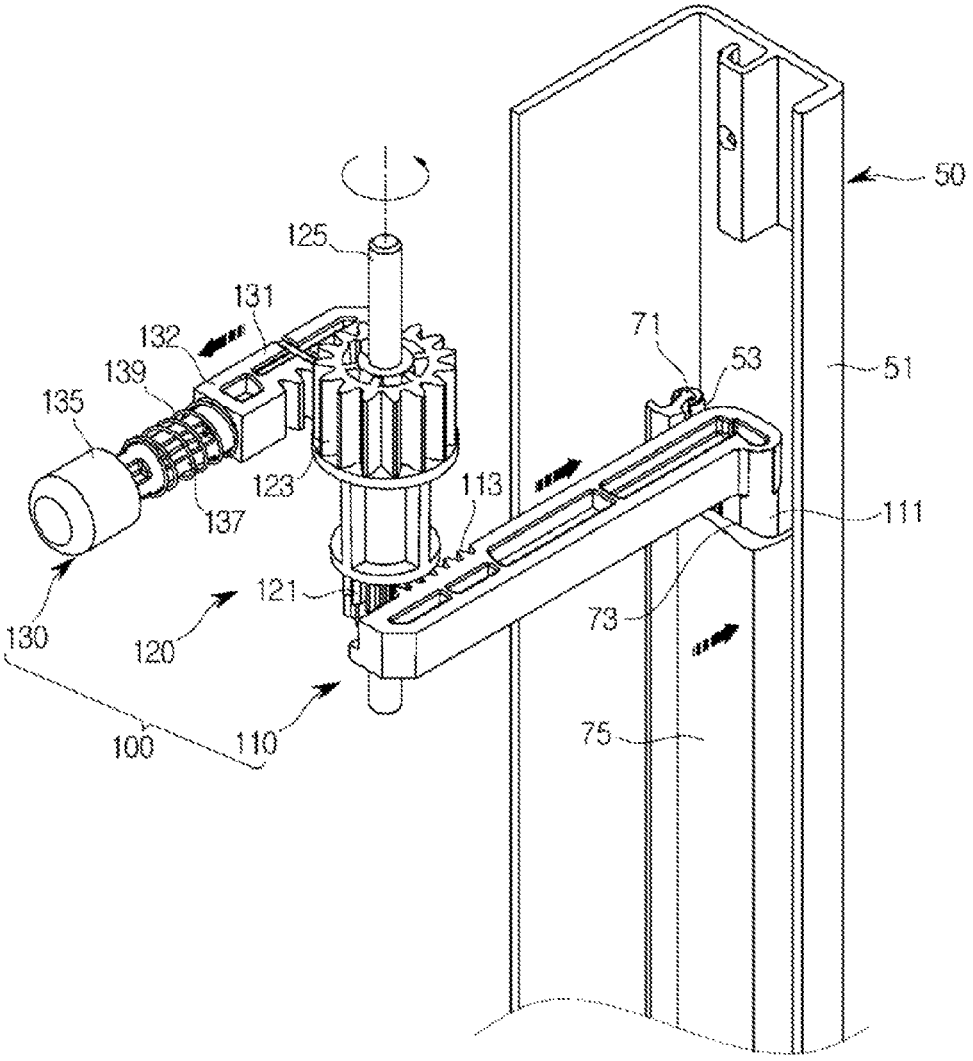

As illustrated in FIG. 15 to FIG. 17, when the first door is closed and a user grips the first handle 50 to push the push portion 75 of the handle lever 70 in a direction of the front surface of the first door 33, the handle lever 70 is rotated about the rotation unit 71 in front of the first door 33 to compress the elastic member.

When the handle lever 70 rotates toward the front surface of first door 33, the first rack 110 connected to the handle lever 70 moves forward.

When the first rack 110 moves forward, the pinion gear 120 engaged with the first rack gear 113 of the first rack 110 is rotated about the rotational shaft 125 in the counterclockwise direction.

When the pinion gear 120 rotates about the rotational shaft 125 in the counterclockwise direction, the second rack 130 engaged with the second gear portion 123 of the pinion gear 120 is moved backward to compress the spring 139 provided at the connection portion 137.

When the second rack 130 moves backward, the contact portion 135 in contact with the main body 10 pushes the fixed main body 10 to separate the first door 33 from the main body 10.

When the first door 33 is separated from the main body 10 by the auxiliary opening apparatus 100, a user may open the first door 33 using a small force.

Figure 18:
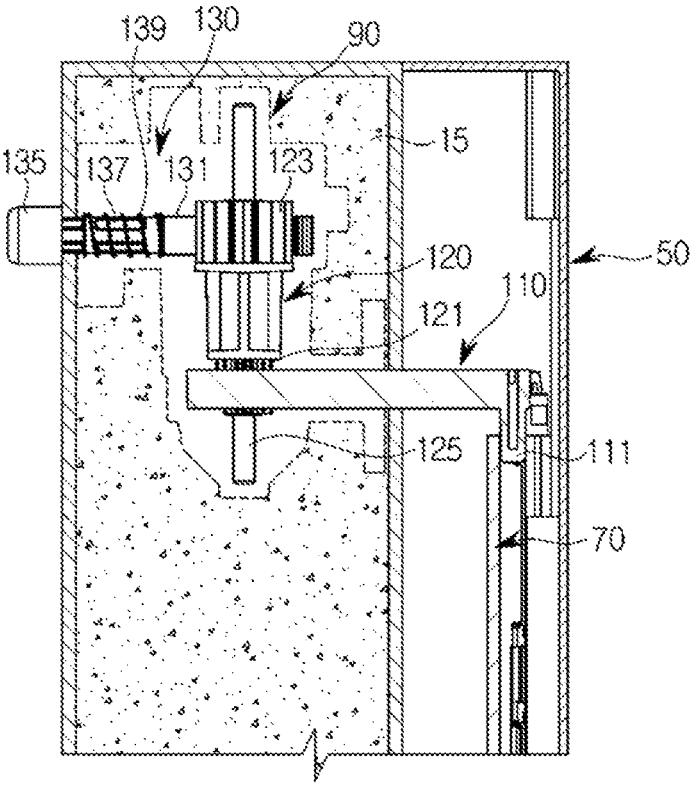
FIG. 18 illustrates when the first door of the refrigerator is open according to various embodiments of the present disclosure.

As illustrated in FIG. 18, when an external force applied to the handle lever 70 is released by a user with the first door 33 in an open state, the handle lever 70 rotates about the rotation unit 71 in a backward direction of the first door 33 due to the compressive force of the elastic member.

In addition, the second rack 130 moved backward by an external force applied to the handle lever 70 is moved forward due to a compressive force of the spring 139, and pinion gear 120 is rotated the rotational shaft 125 in the clockwise direction due to the second rack 130 which moves forward.

The first rack 110 is moved backward due to the pinion gear 120 which rotates in the clockwise direction, and the insertion protrusion 111 of the first rack 110 is inserted into the insertion portion 73 of the handle lever 70.

As is apparent from the above description, the refrigerator 1 according to the embodiments of the present disclosure may decrease the opening force for opening the door.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body including a storage compartment;

a first door rotatably provided in a front of the main body and including an opening;

a second door that is rotatably provided in front of the first door and configured to open or close the opening;

a first handle coupled to a front surface of the first door and configured to open or close the first door;

a second handle provided at the second door and configured to open or close the second door;

an auxiliary opening apparatus configured to separate the first door from the main body and decrease an opening force of the first door;

a handle lever that is provided at the first handle and configured to operate the auxiliary opening apparatus; and a door cap coupled to an upper portion of the first door, wherein a guide portion configured to guide the auxiliary opening apparatus connected to the handle lever to pass through the first door and contact the main body and is coupled to the door cap, wherein the auxiliary opening apparatus includes:

a first rack configured to connect to the handle lever and straightly move forward or backward, a pinion gear configured to engage with the first rack and rotate when the first rack straightly moves, and a second rack configured to engage with the pinion gear and straightly move in a direction opposite to the first rack when the pinion gear rotates, and wherein the handle lever includes:

a rotation unit configured to rotatably couple to a handle lever coupling unit;

an insertion portion into which the auxiliary opening apparatus is inserted; and a push portion to which an external force is applied so that the handle lever rotates about the rotation unit in a direction toward a front surface of the first door.

2. The refrigerator of claim 1, wherein the first handle includes:

a handle bar;

the handle lever coupling unit provided at the handle bar so that the handle lever is rotatably coupled thereto; and a handle cap coupled to an upper portion of the handle bar and configured to prevent the auxiliary opening apparatus connected to the handle lever from being exposed to an outside of the refrigerator.

3. The refrigerator of claim 2, wherein an elastic member is provided between the handle lever and the first handle.

4. The refrigerator of claim 3, wherein the first rack includes:

an insertion protrusion configured to insert into the insertion portion; and a first rack gear configured to engage with the pinion gear.

5. The refrigerator of claim 4, wherein the second rack includes:

a rack gear portion in which a second rack gear is configured to engage with the pinion gear is provided;

a contact portion configured to contact the main body; and a connection portion that is provided between the rack gear portion and the contact portion and comprises a diameter less than those of the rack gear portion and the contact portion, wherein a spring is provided on the connection portion.

6. The refrigerator of claim 5, wherein the pinion gear includes:

a first gear configured to engage with the first rack gear;

a second gear configured to engage with the second rack gear; and a rotational shaft configured to rotatably couple the pinion gear with the guide portion.

7. The refrigerator of claim 6, wherein the door cap includes:

an accommodation portion in which a part of the guide portion is accommodated;

a first coupling hole to which the guide portion is coupled;

a cover that is coupled to an upper portion of the guide portion and configured to cover the upper portion of the guide portion; and a through hole through which the contact portion contacts the main body.

8. The refrigerator of claim 7, wherein the cover includes:

a first rotational hole to which the rotational shaft is rotatably coupled; and a second fastening hole that is provided at a position corresponding to a first fastening hole provided in the guide portion and configured to fasten the cover to the guide portion.

9. The refrigerator of claim 8, wherein the guide portion includes:

an insertion hole into which the first rack is inserted;

a first guide configured to guide the first rack inserted in the insertion hole to straightly move forward or backward;

a second guide configured to guide the second rack to straightly move forward or backward;

an opening that is provided behind the second guide and includes a size less than a diameter of the contact portion and greater than a diameter of the connection portion;

a second rotational hole to which the rotational shaft is rotatably coupled; and a second coupling hole provided at a position corresponding to the first coupling hole.

10. The refrigerator of claim 9, wherein:

one side of the spring is supported by a first support portion provided at an edge of the opening;

an other side of the spring is supported by a second support portion provided at the rack gear portion; and the spring is configured to compress when the second rack moves backward.

11. The refrigerator of claim 10, wherein when the push portion of the handle lever is pushed in a direction toward the front surface of the first door, the handle lever is rotated in the direction toward the front of the first door, and the first rack inserted into the insertion portion is moved forward.

12. The refrigerator of claim 11, wherein when the first rack moves forward, the second rack is configured to move backward and compress the spring, and the contact portion is configured to push the main body to separate the first door from the main body.

13. The refrigerator of claim 12, wherein when an external force applied to the handle lever is released in a state in which the first door separated from the main body is open, the second rack is configured to move forward due to a compressive force of the spring, and the first rack is configured to move backward.

14. A refrigerator comprising:

a main body including a storage compartment;

a first door rotatably provided in a front of the main body and including an opening;

a second door which is rotatably provided in front of the first door and configured to open or close the opening;

an auxiliary opening apparatus configured to separate the first door from the main body and decrease an opening force of the first door;

a handle lever that is provided at a first handle coupled to a front surface of the first door and configured to operate the auxiliary opening apparatus;

a guide portion configured to guide the auxiliary opening apparatus connected to the handle lever to pass through the first door and contact the main body; and a door cap coupled to an upper portion of the first door and including an accommodation portion in which a part of the guide portion is accommodated, a coupling hole to which the guide portion is coupled, a cover configured to cover an upper portion of the guide portion, and a through hole through which the auxiliary opening apparatus contacts the main body, wherein the auxiliary opening apparatus includes:

a first rack configured to connect to the handle lever and straightly move forward or backward, a pinion gear configured to engage with the first rack and rotate when the first rack straightly moves, and a second rack configured to engage with the pinion gear and straightly move in a direction opposite to the first rack when the pinion gear rotates, and wherein the handle lever includes:

a rotation unit configured to rotatably couple to a handle lever coupling unit;

an insertion portion into which the auxiliary opening apparatus is inserted; and a push portion to which an external force is applied so that the handle lever rotates about the rotation unit in a direction toward a front surface of the first door.

15. The refrigerator of claim 14, wherein the guide portion includes:

an insertion hole into which the first rack is inserted;

a first guide configured to guide the first rack inserted into the insertion hole to straightly move forward or backward;

a second guide configured to guide the second rack to straightly move forward or backward; and a rotational hole to which a rotational shaft of the pinion gear is rotatably coupled.

16. A refrigerator comprising:

a main body including a storage compartment;

a first door rotatably provided in a front of the main body and including an opening;

a second door that is rotatably provided in front of the first door and configured to open or close the opening;

an auxiliary opening apparatus configured to separate the first door from the main body and decrease an opening force of the first door;

a handle coupled to the first door to open or close the first door, wherein a handle lever configured to operate the auxiliary opening apparatus is provided at the handle; and a door cap that is coupled to an upper portion of the first door and comprises a space configured to accommodate the auxiliary opening apparatus connected to the handle lever, wherein the auxiliary opening apparatus includes:

a first rack configured to connect to the handle lever and straightly move forward or backward, a pinion gear configured to engage with the first rack and rotate when the first rack straightly moves, and a second rack configured to engage with the pinion gear and straightly move in a direction opposite to the first rack when the pinion gear rotates, and wherein the handle lever includes:

a rotation unit configured to rotatably couple to a handle lever coupling unit;

an insertion portion into which the auxiliary opening apparatus is inserted; and a push portion to which an external force is applied so that the handle lever rotates about the rotation unit in a direction toward a front surface of the first door.

17. A refrigerator comprising:

a main body including a storage compartment;

a first door rotatably provided in a front of the main body and including an opening, wherein a gasket is provided at a rear surface of the first door;

a second door that is rotatably provided in front of the first door and configured to open or close the opening;

an auxiliary opening apparatus configured to separate the first door from the main body and decrease an opening force of the first door;

a handle coupled to the first door and configured to open or close the first door, wherein a handle lever is configured to operate the auxiliary opening apparatus is provided at the handle; and a door cap that is coupled to an upper portion of the first door and comprises a space configured to accommodate the auxiliary opening apparatus, wherein the auxiliary opening apparatus is accommodated in the door cap, is provided in the first door, and comprises one side connected to the handle lever and another side configured to pass through the door cap at an upper portion of the gasket and contact the main body, wherein the auxiliary opening apparatus includes:

a first rack configured to connect to the handle lever and straightly move forward or backward, a pinion gear configured to engage with the first rack and rotate when the first rack straightly moves, and a second rack configured to engage with the pinion gear and straightly move in a direction opposite to the first rack when the pinion gear rotates, and wherein the handle lever includes:

a rotation unit configured to rotatably couple to a handle lever coupling unit;

an insertion portion into which the auxiliary opening apparatus is inserted; and a push portion to which an external force is applied so that the handle lever rotates about the rotation unit in a direction toward a front surface of the first door.

* * * * *